US009318311B2

(12) United States Patent
Chimmalgi et al.

(10) Patent No.: US 9,318,311 B2
(45) Date of Patent: Apr. 19, 2016

(54) PLASMA CELL FOR LASER-SUSTAINED PLASMA LIGHT SOURCE

(71) Applicant: KLA-Tencor Corporation, Milpitas, CA (US)

(72) Inventors: Anant Chimmalgi, San Jose, CA (US); Anatoly Shchemelinin, Pleasanton, CA (US); Ilya Bezel, Sunnyvale, CA (US); Rajeev Patil, Fremont, CA (US)

(73) Assignee: KLA-Tencor Corporation, Milpitas, CA (US)

( * ) Notice: Subject to any disclaimer, the term of this patent is extended or adjusted under 35 U.S.C. 154(b) by 539 days.

(21) Appl. No.: 13/647,680

(22) Filed: Oct. 9, 2012

(65) Prior Publication Data

US 2013/0106275 A1 May 2, 2013

Related U.S. Application Data

(60) Provisional application No. 61/545,692, filed on Oct. 11, 2011.

(51) Int. Cl.

| | |
|---|---|
| ***H01J 61/52*** | (2006.01) |
| ***H01J 61/28*** | (2006.01) |
| ***H01J 65/04*** | (2006.01) |

(52) U.S. Cl.

CPC ..... *H01J 61/526* (2013.01); *H01J 61/28* (2013.01); *H01J 65/04* (2013.01)

(58) Field of Classification Search

CPC ..... H01J 61/526; H01J 61/28; H01J 65/04

See application file for complete search history.

(56) References Cited

U.S. PATENT DOCUMENTS

| | | | | |
|---|---|---|---|---|
| 3,636,395 | A * | 1/1972 | Banes et al. | 313/8 |
| 4,152,625 | A | 5/1979 | Conrad | |
| 5,579,332 | A | 11/1996 | Osborne | |
| 7,435,982 | B2 | 10/2008 | Smith | |
| 7,705,331 | B1 | 4/2010 | Kirk et al. | |
| 2004/0004422 | A1 * | 1/2004 | Claus et al. | 313/26 |
| 2005/0167618 | A1 * | 8/2005 | Hoshino et al. | 250/504 R |
| 2007/0228288 | A1 | 10/2007 | Smith | |
| 2007/0228300 | A1 * | 10/2007 | Smith | 250/504 R |
| 2008/0211379 | A1 * | 9/2008 | Miyamoto et al. | 313/491 |
| 2008/0258085 | A1 | 10/2008 | Bauer | |
| 2008/0265738 | A1 * | 10/2008 | Miyamoto et al. | 313/486 |
| 2009/0032740 | A1 * | 2/2009 | Smith et al. | 250/503.1 |

(Continued)

FOREIGN PATENT DOCUMENTS

| | | | |
|---|---|---|---|
| KR | 10-2007-0110891 | A | 11/2007 |
| WO | 2011017386 | A1 | 2/2011 |

OTHER PUBLICATIONS

A. Schreiber et al., Radiation resistance of quartz glass for VUV discharge lamps, Journal of Physics D: Applied Physics, Aug. 19, 2005, p. 3242-3250, vol. 38, IOP Publishing Ltd, Printed in the UK.

*Primary Examiner* — Elmito Breval

(74) *Attorney, Agent, or Firm* — Suiter Swantz pc llo

(57) ABSTRACT

A refillable plasma cell for use in a laser-sustained plasma light source includes a plasma bulb, the bulb being formed from a glass material substantially transparent to a selected wavelength of radiation, and a gas port assembly, the gas port assembly being operably connected to the bulb and disposed at a first portion of the gas bulb, wherein the bulb is configured to selectively receive a gas from a gas source via the gas port assembly.

46 Claims, 8 Drawing Sheets

(56) References Cited

U.S. PATENT DOCUMENTS

2009/0134761 A1* 5/2009 Hendriks et al. ..... 313/46
2009/0230838 A1* 9/2009 Takao et al. ..... 313/490
2009/0322240 A1 12/2009 Espiau et al.
2010/0097808 A1 4/2010 Jurik
2011/0181191 A1* 7/2011 Smith et al. ..... 315/149

* cited by examiner

PLASMA CELL FOR LASER-SUSTAINED PLASMA LIGHT SOURCE

CROSS-REFERENCE TO RELATED APPLICATION

The present application is related to and claims the benefit of the earliest available effective filing date(s) from the following listed application(s) (the "Related Applications") (e.g., claims earliest available priority dates for other than provisional patent applications or claims benefits under 35 USC §119(e) for provisional patent applications, for any and all parent, grandparent, great-grandparent, etc. applications of the Related Application(s)).

RELATED APPLICATIONS

For purposes of the USPTO extra-statutory requirements, the present application constitutes a regular (non-provisional) patent application of United States Provisional Patent Application entitled GLASS ENCLOSED GAS CELL DESIGNS FOR LASER SUSTAINED PLASMA LIGHT SOURCES, naming Anant Chimmalgi, Anatoly Shchemelinin, Ilya Bezel, and Rajeev Patil as inventors, filed Oct. 11, 2011, Application Ser. No. 61/545,692.

TECHNICAL FIELD

The present invention generally relates to plasma based light sources, and more particularly to gas bulb configurations and electrode configurations in laser-sustained plasma cells.

BACKGROUND

As the demand for integrated circuits with ever-shrinking device features continues to increase, the need for improved illumination sources used for inspection of these ever-shrinking devices continues to grow. One such illumination source includes a laser-sustained plasma source. Laser-sustained plasma light sources (LSPs) are capable of producing high-power broadband light. Laser-sustained light sources operate by focusing laser radiation into a gas volume in order to excite the gas, such as argon, xenon, mercury and the like, into a plasma state, which is capable of emitting light. This effect is typically referred to as "pumping" the plasma. In order to contain the gas used to generate the plasma, an implementing plasma cell requires a "bulb," which is configured to contain the gas species as well as the generated plasma.

A typical laser sustained plasma light source may be maintained utilizing an infrared laser pump having a beam power on the order of several kilowatts. The laser beam from the given laser-based illumination source is then focused into a volume of a low or medium pressure gas in a plasma cell. The absorption of laser power by the plasma then generates and sustains the plasma (e.g., 12K-14K plasma). Typically, a plasma cell includes a pair of electrodes used to initiate plasma generation in the given plasma cell. For example, the electrodes of a given plasma cell may produce a discharge arc or corona discharge suitable for initiating plasma generation within the given plasma cell.

As pumping powers continue to increase and plasmas become larger and hotter, thermal management in the glass cells becomes increasingly difficult. In a general sense, plasma cools down by several mechanisms, including radiation, convection, and the like. In turn, the cooling of the plasma can heat regions of the gas cell. In addition, the plasma also includes several mechanisms for heating the electrodes, which, in turn, radiatively or conductively heat the glass bulb of the plasma cell.

In the event the glass enclosure of the plasma cell reaches temperatures in excess of the softening point of the glass wall of the bulb of the plasma cell, then the cell is at risk of rupturing during operation (or after cooling). Therefore, it would be desirable to provide a plasma cell that corrects the deficiencies identified in the prior art.

SUMMARY

A refillable plasma cell suitable for use in a laser-sustained plasma light source is disclosed. In one aspect, the refillable plasma cell may include, but is not limited to, a plasma bulb, the bulb being formed from a glass material substantially transparent to a selected wavelength of radiation; and a gas port assembly, the gas port assembly being operably connected to the bulb and disposed at a first portion of the gas bulb, wherein the bulb is configured to selectively receive a gas from a gas source via the gas port assembly.

A plasma cell equipped with a heat pipe for use in a laser-sustained plasma light source is disclosed. In one aspect, the plasma cell may include, but is not limited to, a plasma bulb, the bulb being formed from a glass material substantially transparent to a selected wavelength of radiation; one or more electrodes disposed within the bulb, the one or more electrodes configured to initiate plasma generation within the bulb; and a heat pipe in thermal communication with the one or more electrodes, the heat pipe further being in thermal communication with a heat exchanger, the heat exchanger configured to transfer thermal energy from within the plasma bulb to a medium external to the plasma bulb.

A plasma cell equipped with one or more radiation shields for use in a laser-sustained plasma light source is disclosed. In one aspect, the plasma cell may include, but is not limited to, a plasma bulb, the bulb being formed from a glass material substantially transparent to a selected wavelength of radiation, wherein the plasma bulb is configured to contain a gas suitable for plasma generation; one or more electrodes disposed within the bulb, the one or more electrodes configured to initiate plasma generation within the bulb; and one or more radiation shields disposed on the one or more electrodes, wherein the one or more radiation shields are configured to shield the glass material of the bulb from radiation emitted by a plasma region within the plasma bulb.

An electrodeless plasma cell suitable for use in a laser-sustained plasma light source is disclosed. In one aspect, the plasma cell may include, but is not limited to, a plasma bulb, the bulb being formed from a glass material substantially transparent to a selected wavelength of radiation, wherein the plasma bulb is configured to contain a gas suitable for plasma generation; and a plasma generation region within the plasma bulb, wherein the plasma generation region is configured to initiate a plasma within the bulb via absorption of radiation from a pumping laser, wherein the plasma bulb is configured to initiate the plasma without electrodes.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the disclosure may be better understood by those skilled in the art by reference to the accompanying figures in which.

DETAILED DESCRIPTION OF THE INVENTION

Reference will now be made in detail to the subject matter disclosed, which is illustrated in the accompanying drawings.

Referring generally to FIGS. 1 through 6, a plasma cell suitable for use in a laser sustained plasma light source is described in accordance with the present invention. In one aspect, the present invention is directed to a refillable plasma cell suitable for allowing for pressure control and gas mixture control in a given plasma cell. In another aspect, the present invention is directed to a plasma cell designed to control cooling mechanisms associated with the plasma contained within the gas bulb of the plasma cell. In a further aspect, the present invention is directed to controlling the cooling mechanisms associated with one or more electrodes of the given plasma cell. By controlling the cooling mechanisms associated with the plasma and electrodes of a plasma cell, the glass temperature of the bulb of the plasma cell may be controlled within acceptable operational limits, thereby minimizing the likelihood of malfunction of the bulb of the plasma cell.

The plasma cell of the present invention includes a plasma bulb having a selected shape and formed from a glass material substantially transparent to at least a portion of the illumination from the pumping laser source and the broadband emission from the plasma. In some embodiments, the plasma cell of the present invention further includes one or more electrodes disposed within the bulb of the plasma cell and used to initiate plasma generation with the bulb of the plasma. In other embodiments, the plasma cell of the present invention is configured to initiate plasma generation in the absence of electrodes.

The generation of plasma within inert gas species is generally described in U.S. patent application Ser. No. 11/695,348, filed on Apr. 2, 2007; and U.S. patent application Ser. No. 11/395,523, filed on Mar. 31, 2006, which are incorporated herein in their entirety.

Figure 1:
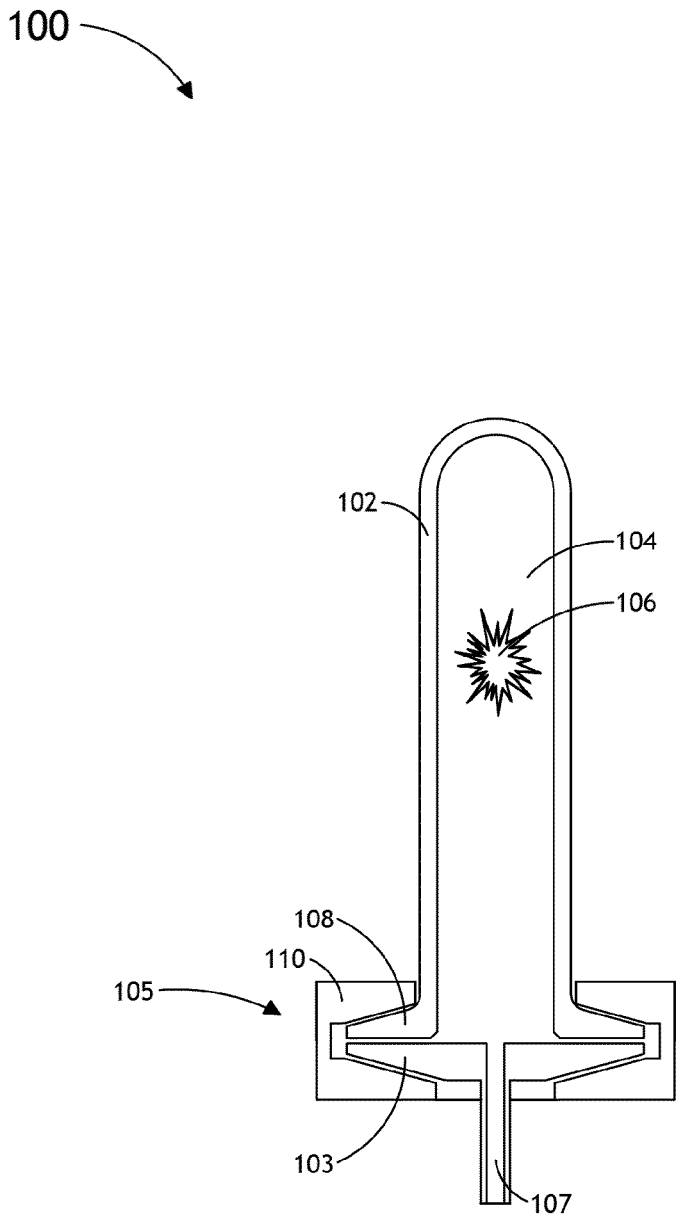
FIG. 1 illustrates a simplified schematic view of a refillable plasma cell, in accordance with one embodiment of the present invention.

FIG. 1 illustrates a refillable plasma cell 100 for use in a laser-sustained plasma light source, in accordance with one embodiment of the present invention. In one aspect, the plasma cell 100 may include a gas port assembly 105 operably coupled to a portion of the plasma bulb 102. For example, the plasma cell 100 of the present invention may include a gas port assembly 105 mechanically connected to the bottom portion of the bulb 102 and configured to facilitate the selective transfer of a gas from a gas source to an internal region 104 of the bulb 102 of the plasma cell 100.

In one embodiment, the gas port assembly 105 may include a fill port 107, a delivery cap 103, a receiving cap 108, and a clamp 110 suitable for mechanically securing the delivery cap 103 to the receiving cap 108. In this regard, a seal may be established between the delivery cap 103 and the receiving cap 108 by utilizing the clamp 110. In a further aspect, gas from a gas source (not shown) may be transported (i.e., flowed) from the gas source into the internal volume 104 of the glass bulb 102 via the fill port 107 of the gas port assembly 105. In a further embodiment, the fill port 107, the delivery cap 103, the receiving cap 108, and the clamp 110 may each be constructed from a selected metal (e.g., stainless steel).

In a further aspect, the refillable plasma cell 100 allows for the regulation of the gas pressure within the bulb 102 of the plasma cell 100. In this regard, a gas control system (not shown) may be utilized to fill the gas bulb 102 to a selected pressure required for a given application. In addition, the gas control system may be utilized to relieve pressure within the bulb 102. It is further contemplated that the gas pressure within the bulb 102 may be controlled manually by a user via a gas regulator (not shown) operably coupled to the fill port 107 of the gas port assembly 105.

In another aspect, the refillable plasma cell 100 allows for the switching of the type of gas within the bulb 102 of the plasma cell 100. In this regard, a user or communicatively coupled control system may switch the type of gas contained within the bulb 102 utilizing the fill port 107 of the gas port assembly 105. In a further embodiment, the relative components of a given gas mixture within the plasma cell 100 may be controlled by the gas port assembly 105. For example, the type of gas (or the relative amount of components in a gas mixture) within the bulb may be switched based on the given needs of the plasma cell 100. For instance, the optimal gas (or gas mixture) required for ignition of the plasma within the bulb 102 may be different than the optimal gas type for a given operational mode of the plasma cell 100. As such, following ignition of the plasma 106 within the bulb 102, the gas port assembly 105 may be used to displace an initial ignition gas with a subsequent operation gas.

It is contemplated herein that the refillable plasma cell 102 of the present invention may be utilized to sustain a plasma in a variety of gas environments. In one embodiment, the gas of the plasma cell may include an inert gas (e.g., noble gas or non-noble gas) or a non-inert gas (e.g., mercury). For example, it is anticipated herein that the volume of gas of the present invention may include argon. For instance, the gas may include a substantially pure argon gas held at pressure in excess of 5 atm. In another instance, the gas may include a substantially pure krypton gas held at pressure in excess of 5 atm. In a general sense, the glass bulb 102 may be filled with any gas known in the art suitable for use in laser sustained plasma light sources. In addition, the fill gas may include a mixture of two or more gases. The gas used to fill the gas bulb 102 may include, but is not limited to, Xe, Ar, Ne, Kr, He, $N_2$, $H_2O$, $O_2$, $H_2$, $D_2$, $F_2$, $CH_4$, one or more metal halides, a halogen, Hg, Cd, Zn, Sn, Ga, Fe, Li, Na, Ar:Xe, ArHg, KrHg, XeHg, and the like. In a general sense, the present invention should be interpreted to extend to any light pump plasma generating system and should further be interpreted to extend to any type of gas suitable for sustaining a plasma within a plasma cell.

In one embodiment, the plasma cell 100 may include one or more electrodes (not shown in FIG. 1) disposed within the bulb 102 of the plasma cell 100. The one or more electrodes may be configured to initiate plasma generation 106 within the bulb 102. Particular configurations of the one or more electrodes of this embodiment are described in greater detail further herein. In an alternative embodiment, the plasma cell 100 may be configured to initiate plasma 106 generation without electrodes. In this configuration, the plasma cell 100 may be electrodeless.

In another aspect, the bulb 102 of the plasma cell may be formed from a material, such as glass, being substantially transparent to one or more selected wavelengths (or wavelength ranges) of illumination from an associated illumination source, such as a laser, and broadband emissions from the plasma 106. The glass bulb may be formed from a variety of glass materials. In some embodiments, the glass bulb 102 may be formed from a low OH content fused synthetic quartz glass material. In other embodiments, the glass bulb 102 may be formed from a high OH content fused synthetic silica glass material. For example, the glass bulb 202 may include, but is not limited to, SUPRASIL 1, SUPRASIL 2, SUPRASIL 300, SUPRASIL 310, HERALUX PLUS, HERALUX-VUV, and the like. Various glasses suitable for implementation in the glass bulb of the present invention are discussed in detail in A. Schreiber et al., *Radiation Resistance of Quartz Glass for VUV Discharge Lamps*, J. Phys. D: Appl. Phys. 38 (2005), 3242-3250, which is incorporated herein in the entirety.

In another aspect of the present invention, the illumination source used to pump the plasma 106 of the plasma cell 100 may include one or more lasers. In a general sense, the illumination source may include any laser system known in the art. For instance, the illumination source may include any laser system known in the art capable of emitting radiation in the visible or ultraviolet portions of the electromagnetic spectrum. In one embodiment, the illumination source may include a laser system configured to emit continuous wave (CW) laser radiation. For example, in settings where the gas of the volume is or includes argon, the illumination source may include a CW laser (e.g., fiber laser or disc Yb laser) configured to emit radiation at 1069 nm. It is noted that this wavelength fits to a 1068 nm absorption line in argon and as such is particularly useful for pumping the gas. It is noted herein that the above description of a CW laser is not limiting and any CW laser known in the art may be implemented in the context of the present invention.

In another embodiment, the illumination source may include one or more diode lasers. For example, the illumination source may include one or more diode lasers emitting radiation at a wavelength corresponding with any of one or more absorption lines of the species of the gas of the plasma cell. In a general sense, a diode laser of the illumination source may be selected for implementation such that the wavelength of the diode laser is tuned to any absorption line of any plasma (e.g., ionic transition line) or any absorption line of the plasma-producing gas (e.g., highly excited neutral transition line) known in the art. As such, the choice of a given diode laser (or set of diode lasers) will depend on the type of gas utilized in the plasma cell of the present invention.

In another embodiment, the illumination source may include an ion laser. For example, the illumination source may include any noble gas ion laser known in the art. For instance, in the case of an argon-based plasma, the illumination source used to pump argon ions may include an Ar+ laser.

In one another embodiment, the illumination source may include one or more frequency converted laser systems. For example, the illumination source may include a Nd:YAG or Nd:YLF laser having a power level exceeding 100 Watts. In another embodiment, the illumination source may include a broadband laser. In another embodiment, the illumination source may include a laser system configured to emit modulated laser radiation or pulse laser radiation.

In another aspect of the present invention, the illumination source may include two or more light sources. In one embodiment, the illumination source may include two or more lasers. For example, the illumination source (or illumination sources) may include multiple diode lasers. By way of another example, the illumination source may include multiple CW lasers. In a further embodiment, each of the two or more lasers may emit laser radiation tuned to a different absorption line of the gas or plasma within the plasma cell.

Figure 2:
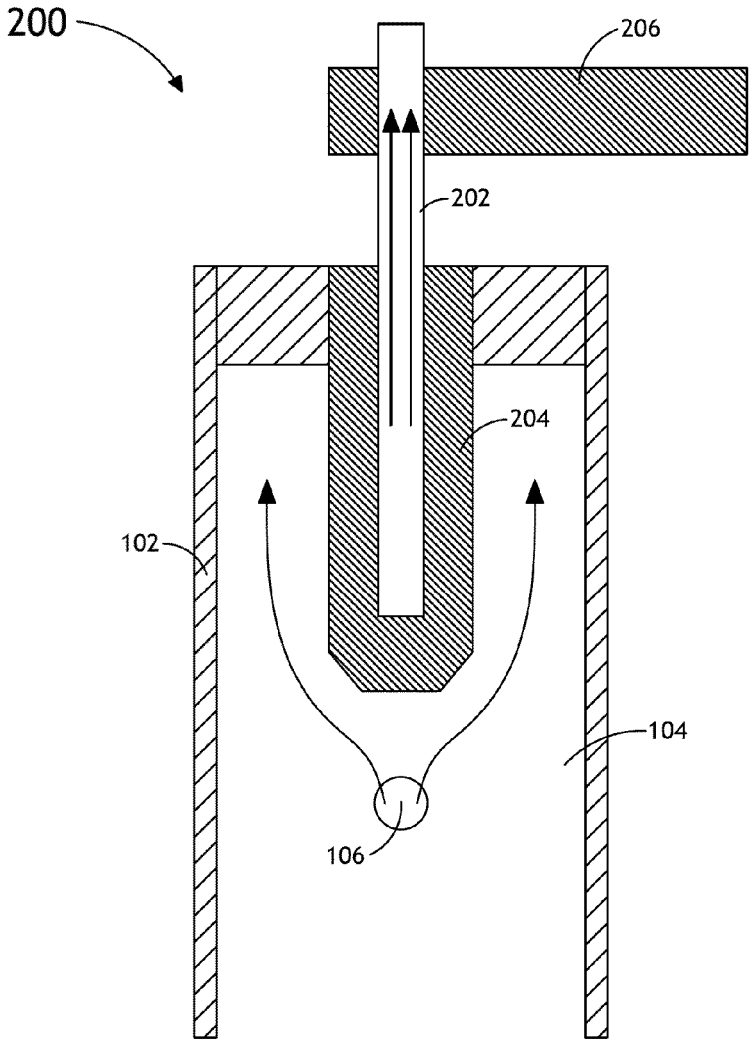
FIG. 2 illustrates a simplified schematic view of a plasma cell having a heat pipe, in accordance with one embodiment of the present invention.

FIG. 2 illustrates a plasma cell 200 equipped with a heat pipe 202 for use in a light-sustained plasma light source, in accordance with one embodiment of the present invention. In one aspect, the plasma cell 200 includes one or more electrodes 204 (e.g., top electrode and/or bottom electrode) disposed within the bulb 102, whereby the one or more electrodes 204 are configured to initiate plasma generation within the bulb 102. Particular configurations for the one or more electrodes 204 are discussed in more detail further herein.

In another aspect, the plasma cell 100 includes the heat pipe 202 placed in thermal communication with the one or more electrodes 204. Further, the heat pipe 202 is placed in thermal communication with a heat exchanger 206. In this regard, the heat pipe 202 may transfer thermal energy from within the plasma bulb 102 to the heat exchanger 206 disposed at a region external to the bulb 102 of the plasma cell 200. The heat exchanger 206 is further configured to transfer the received thermal energy from the heat pipe 202 to a medium (e.g., heat sink) external to the plasma bulb 102.

In one embodiment, the heat pipe 202 is configured to transfer thermal energy from one or more electrodes 204 of the plasma bulb 102 to a medium external to the plasma bulb 102 via the heat exchanger 206. In another embodiment, the heat pipe 202 is configured to transfer thermal energy from a plume (not shown in FIG. 2) generated by rising gas from the plasma region 106 of the plasma bulb 102 to a medium external to the plasma bulb 102 via the heat exchanger 206. In this regard, the heat pipe 202 may act to cool the plasma bulb 102 by transfer of thermal energy from the electrode 204 and/or the plume generated by the plasma region 106.

In one embodiment, the heat pipe 202 includes a volume of molten material disposed within the heat pipe 202. In one embodiment, the heat pipe 202 includes a volume of gaseous material disposed within the heat pipe 202. In a further embodiment, the volume of molten or gaseous material may extend from the "hot" end of the heat pipe 202 (i.e., end of heat pipe in contact with electrode) to the "cold" end of the heat pipe 202 (i.e., end of heat pipe in thermal contact with heat exchanger 206).

In an additional embodiment, the heat pipe 202 is a phase transition based heat pipe. In this regard, the heat pipe 202 may contain mixed phases of material. For example, at the "hot" electrode 204 interface, the material within the heat pipe 202 may transform from a molten material to a gas by absorbing heat from hot electrode 204. Then, the gaseous material may migrate toward the "cold" heat exchanger 206 interface and condense back into molten form at the cold interface by transferring thermal energy from the volume of the heat pipe material to the heat exchanger 206. Then, the molten material returns back to the hot interface either through gravity action or capillary action at which point the process is repeated. It is noted herein that any heat pipe device known in the art is suitable for implementation in the present invention.

It is noted herein that the types of gas fills, glass bulb materials, and laser-pumping sources discussed previously herein with respect to FIG. 1 should be interpreted to extend to the plasma cell 200 of the present disclosure unless otherwise noted. In addition, it is further anticipated that the heat pipe of plasma cell 200 of the present invention may be implemented in a refillable plasma cell 100 configuration (as described previously herein) or in a non-refillable plasma cell.

Figure 3:
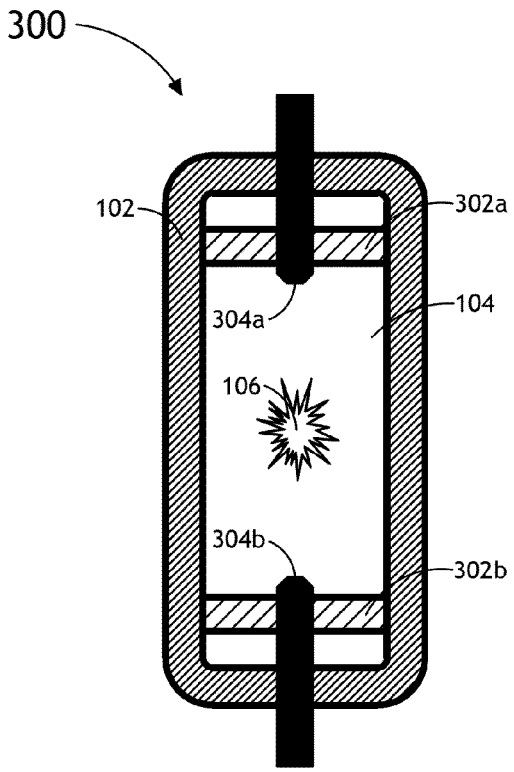
FIG. 3 illustrates a simplified schematic view of a plasma cell having at least one radiation shield disposed on one or more electrodes, in accordance with one embodiment of the present invention.

FIG. 3 illustrates a plasma cell 300 equipped with one or more radiation shields for use in a laser-sustained plasma light source, in accordance with one embodiment of the present invention. In one aspect, the plasma cell 300 includes one or more electrodes 304*a*, 304*b* (e.g., top electrode 304*a* and/or bottom electrode 304*b*) disposed within the bulb 102, whereby the one or more electrodes 304*a* and 304*b* are configured to initiate plasma generation within the bulb 102. Particular configurations for the one or more electrodes 304*a* and 304*b* are discussed in more detail further herein.

In another aspect, the plasma cell 300 includes one or more radiation shields 302*a* and/or 302*b* coupled to or near one or more of the one or more electrodes 304*a*, 304*b*. For example, a top radiation shield 302*a* may be coupled to the top electrode 304*a*. In this regard, the top electrode 304*a* may pass through an opening of the radiation shield 302*a*, allowing the electrode an electrical channel to the bottom electrode 304*b*. Similarly, a bottom radiation shield 302*b* may be coupled to the bottom electrode 304*b*. In this manner, the top radiation shield 302*a* and/or the bottom radiation shield 302*b* may act to provide a radiation shield for the top and bottom portions of the glass bulb 102. In this regard, the radiation shields 302*a*/302*b* may act to reduce radiation damage caused to the glass bulb 102 by radiation emanating from the plasma region 106 of the plasma cell 300.

In a further aspect, the radiation shields 302*a*/302*b* may also act to redirect convection currents within the plasma bulb 102 of the plasma cell 300. In this regard, the radiation shields 302*a*/302*b* may impact the flow of hot gas from the hot plasma region 106 of the plasma cell 102 to the cooler inner surfaces of the glass bulb 102. In this regard, the radiation shields 302*a*/302*b* may be configured in a manner to direct convective flow to regions within the plasma bulb that minimize or at least reduce damage to the bulb 102 caused by the high temperature gas. It is noted that the particular position, size, and thickness of the radiation shields 302*a*/302*b* may depend on a number of factors. In particular, the various characteristics of the radiation shield may depend on the operation limits placed on the glass bulb 102 of the cell 300.

It is again noted herein that the types of gas fills, glass bulb materials, and laser-pumping sources discussed previously herein with respect to FIG. 1 should be interpreted to extend to the plasma cell 300 of the present disclosure unless otherwise noted. In addition, it is further anticipated that the radiation shields of plasma cell 300 may be implemented with or without the heat pipe described in plasma cell 200 of the present invention and may be implemented in a refillable plasma cell 100 configuration (as described previously herein) or in a non-refillable plasma cell.

FIGS. 4A-4D illustrate a series of plasma cell electrode configurations suitable for implementation in the present invention. Those skilled in the art should recognize that a plasma cell of a laser sustained plasma light source may include one or more electrodes used to initiate plasma generation within the plasma cell. It is noted herein that the foregoing electrode configurations may be implemented in combination with any of the embodiments described in the present disclosure (e.g., embodiments of FIGS. 1-3 and FIG. 5A-5B). In one embodiment, the one or more electrodes of a plasma cell may be used to generate a discharge arc capable of initiating plasma generation within the bulb of the given plasma cell. In another embodiment, the one or more electrodes of a plasma cell may be used to generate a corona discharge capable of initiating plasma generation within the bulb of the plasma cell. Then, the plasma species may be maintained utilizing a "pumping" laser, whereby laser light of a selected wavelength is focused into the volume of gas within the bulb of the plasma cell and energy is absorbed through one or more selected absorption lines of the gas or plasma within the bulb.

Figure 4B:
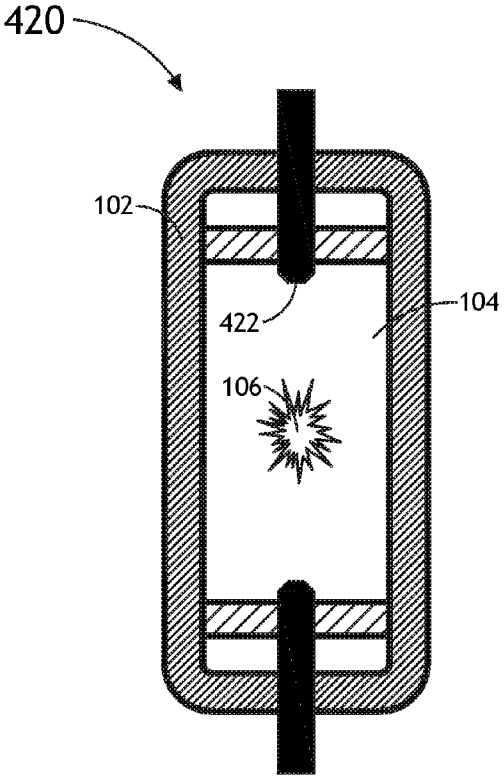
FIG. 4B illustrates a simplified schematic view of a plasma cell having a substantially flat electrode configured to protect a top portion of the bulb, in accordance with one embodiment of the present invention.
Figure 4A:
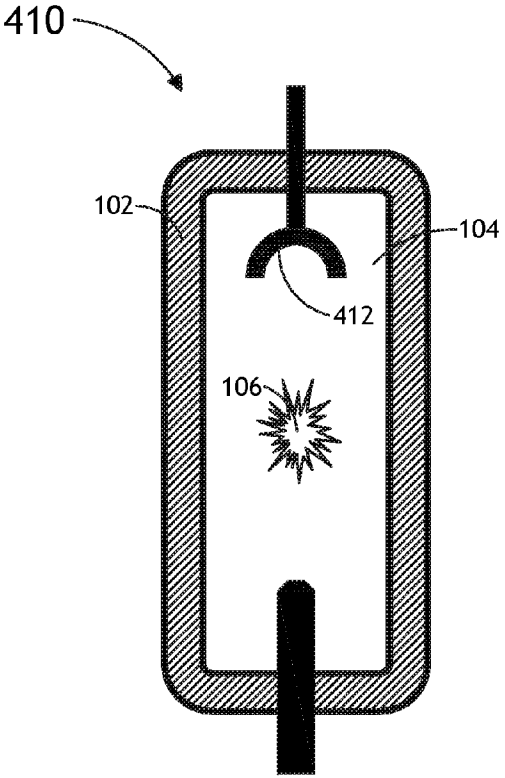
FIG. 4A illustrates a simplified schematic view of a plasma cell having at least one concave electrode, in accordance with one embodiment of the present invention.

FIG. 4A illustrates a plasma cell 410 having a concave top electrode 412. In one aspect, the plasma cell 410 includes a concave top electrode 412 suitable for capturing and redirecting a convection "plume" emanating from the plasma region 106 within the bulb 102 of the plasma cell 410. It is noted that the particular position and size of the concave portion of the concave electrode 412 may depend on a number of factors. In particular, the particular arrangement of the concave electrode 412 may depend on the operation limits placed on the glass bulb 102 of the cell 410. In this sense, the position and size of the electrode 412 may be selected in order to minimize (or at least reduce) the temperature of selected portions of the glass bulb 102.

FIG. 4B illustrates a plasma cell 410 having a flattened top electrode 422. In one aspect, the plasma cell 420 includes a small flattened top electrode 422 suitable for protecting the top portion of the bulb 102 from the plasma region 106. In a further aspect, the flattened top electrode 422 may be in thermal communication with a heat sink (not shown) located directly above the flattened top electrode 422, allowing for the efficient removal of heat from the electrode 422.

Figure 4D:
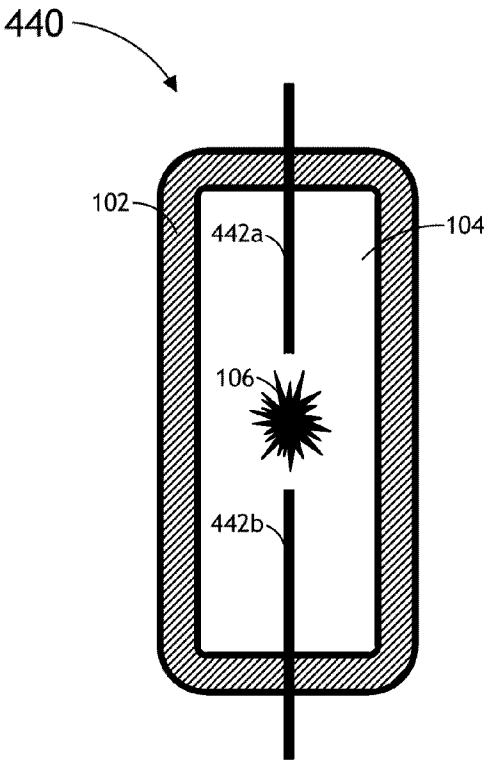
FIG. 4D illustrates a simplified schematic view of a plasma cell having a substantially filamentary electrode, in accordance with one embodiment of the present invention.
Figure 4C:
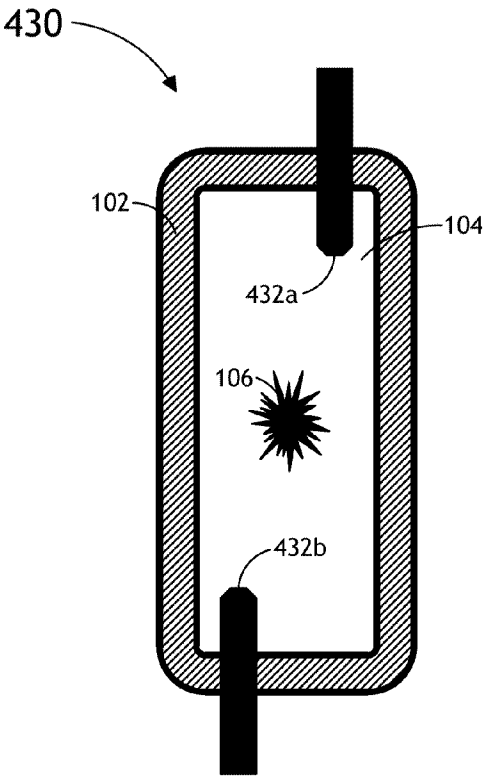
FIG. 4C illustrates a simplified schematic view of a plasma cell having one or more electrodes arranged off-center relative to the center of the plasma bulb, in accordance with one embodiment of the present invention.

FIG. 4C illustrates a plasma cell 430 having a set of off-centered electrodes 432*a*, 432*b*. In one aspect, a top electrode 432*a* may be offset from the center of the plasma cell 430 in a direction opposite to the offset direction of the bottom electrode 432*b*. In one embodiment, the offset electrodes 432*a* and 432*b* may include electrodes formed from wire. In another embodiment, the offset electrodes 432*a* and 432*b* may include electrodes formed from foil.

FIG. 4D illustrates a plasma cell 440 having a set of thin electrodes 442*a*, 442*b*. In one embodiment, the top and bottom electrodes 442*a* and 442*b* may include electrodes formed from wire. In another embodiment, the top and bottom electrodes 442*a* and 442*b* may include electrodes formed from foil. It is noted herein that the utilization of "thin" electrodes, such as wire-based electrodes, may aid in reducing thermal energy transfer from the plasma region 106 to the electrodes.

Figure 5A:
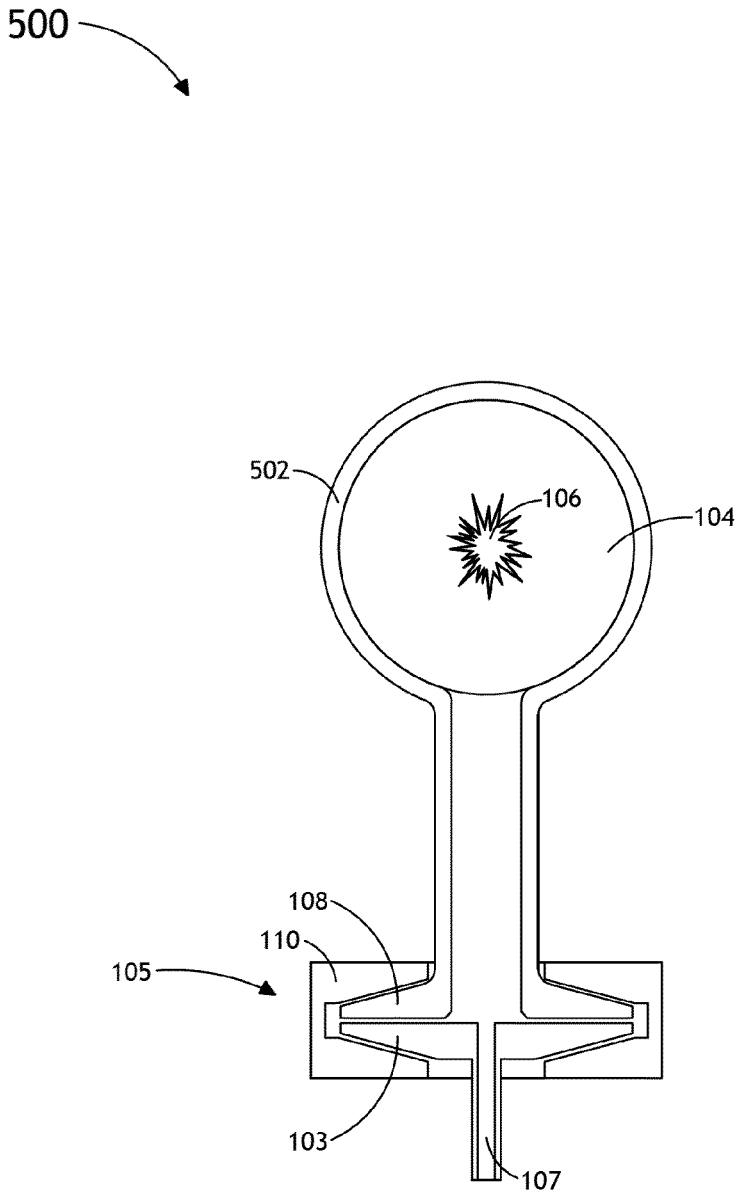
FIG. 5A illustrates a simplified schematic view of a plasma cell having a substantially spherical plasma bulb, in accordance with one embodiment of the present invention.
Figure 5B:
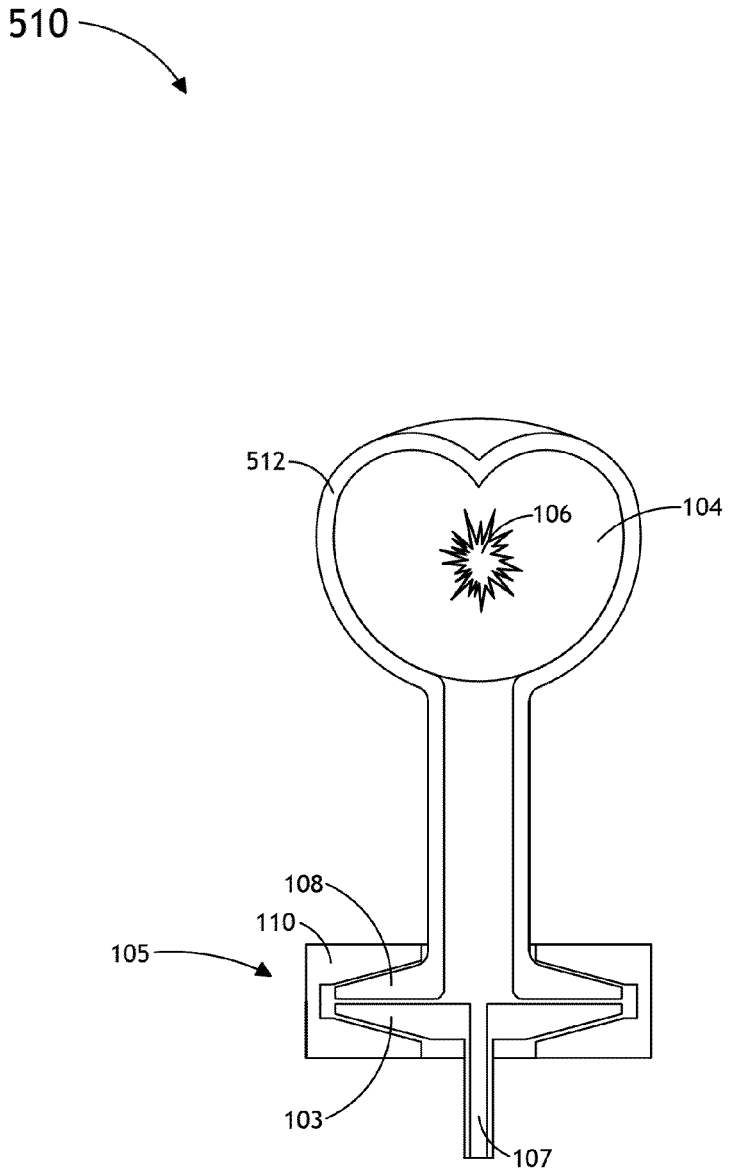
FIG. 5B illustrates a simplified schematic view of a plasma cell having a substantially cardioid plasma bulb, in accordance with one embodiment of the present invention.

FIGS. 5A-5B illustrate alternative plasma bulb shapes suitable for implementation in the present invention. It is noted herein that the foregoing plasma bulb shapes, along with the cylindrical plasma bulb shape of FIG. 1, may be implemented in combination with any of the embodiments described in the present disclosure (e.g., embodiments of FIGS. 1-3, 4A-4D and FIG. 6).

FIG. 5A illustrates a plasma cell 500 having a spherical-shaped plasma bulb 502. It is noted herein that the spherical shape of the plasma bulb 502 may reduce or eliminate the need for aberration compensation of the plasma generated illumination. FIG. 5B illustrates a plasma cell 510 having a cardioid-shaped plasma bulb 512, in accordance with an alternative embodiment of the present invention. In one aspect, the cardioid shaped plasma bulb 512 may include a peak on the internal surface of the glass bulb 512 configured to direct convection within the volume 104 of the plasma cell 510.

While FIGS. 1, 5A, and 5B illustrate various plasma bulb shapes implemented in the context of refillable bulbs (equipped with a gas port assembly 105), it is noted herein that each of the plasma bulb shapes described in the present invention may also be implemented in a non-refillable plasma cell.

Figure 6:
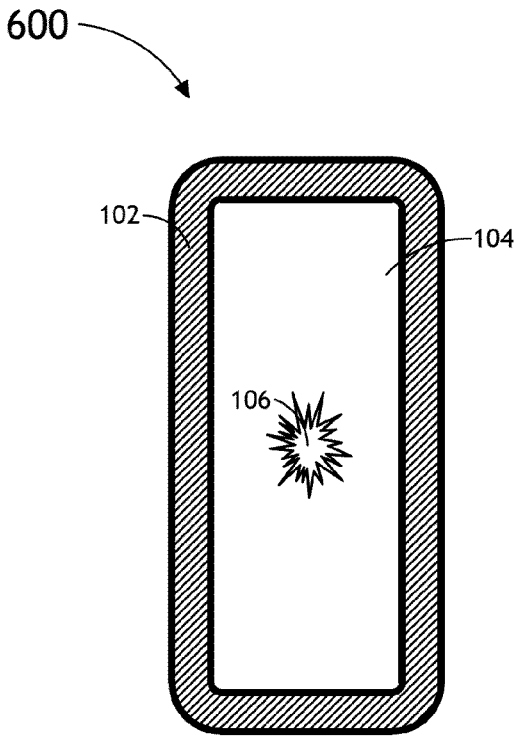
FIG. 6 illustrates a simplified schematic view of an electrodeless plasma cell, in accordance with one embodiment of the present invention.

FIG. 6 illustrates an electrodeless plasma cell 600, in accordance with an alternative embodiment of the present invention. In one aspect, the plasma cell 600 is configured to initiate plasma generation without the need of one or more electrodes. In this regard, the plasma bulb is filled with a suitable gas and capable of receiving radiation from a pumping laser (not shown) such that the plasma 106 may be initiated within the plasma bulb 102 via absorption of radiation from a pumping laser, without the need for ignition electrodes. It is noted that the absence of electrodes in a plasma cell eliminates one source of bulb glass heating, namely the transfer of heat from a heated electrode to the glass material of the surrounding bulb.

Applicant notes that various embodiments of the present disclosure are applicable to the electrodeless cell 600 of FIG. 6. For example, the electrodeless cell 600 may be implemented with any bulb shape (e.g., cylindrical 100, spherical 500, and cardioid 510) described in the present disclosure. In addition, it is noted that the radiation shield(s) described in the context of FIG. 3 may be implemented in an electrodeless plasma cell 600. Further, the electrodeless plasma cell 600 may include a refillable plasma cell or a non-refillable plasma cell.

In a further aspect, the various gas fill materials, laser sources, and bulb gas material described with respect to plasma cell 100 should be interpreted to extend to the electrodeless plasma cell 600 of FIG. 6.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "connected", or "coupled", to each other to achieve the desired functionality, and any two components capable of being so associated can also be viewed as being "couplable", to each other to achieve the desired functionality. Specific examples of couplable include but are not limited to physically mateable and/or physically interacting components and/or wirelessly interactable and/or wirelessly interacting components and/or logically interacting and/or logically interactable components.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein.

Although particular embodiments of this invention have been illustrated, it is apparent that various modifications and embodiments of the invention may be made by those skilled in the art without departing from the scope and spirit of the foregoing disclosure. Accordingly, the scope of the invention should be limited only by the claims appended hereto.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

Furthermore, it is to be understood that the invention is defined by the appended claims.

What is claimed:

1. A refillable plasma cell suitable for use in a laser-sustained plasma light source, comprising:

a plasma bulb, the bulb being formed from a glass material substantially transparent to a selected wavelength of radiation; and a gas port assembly, the gas port assembly including a receiving cap, the receiving cap being reversibly couplable to a delivery cap so as to establish a reversible fluidic connection between a gas source and an internal portion of the plasma bulb.

2. The plasma cell of claim 1, wherein the bulb has at least one of a substantially cylindrical shape and a substantially spherical shape.

3. The plasma cell of claim 1, wherein the bulb has a substantially cardioid shape.

4. The plasma cell of claim 1, wherein the bulb has a peak disposed on the internal surface of the bulb configured to direct convection within the plasma bulb.

5. The plasma cell of claim 1, wherein the bulb is electrodeless.

6. The plasma cell of claim 1, further comprising:

one or more electrodes disposed within the bulb, the one or more electrodes configured to initiate plasma generation within the bulb.

7. The plasma cell of claim 6, wherein the one or more electrodes comprise:

a concave electrode configured for capture and redirection of a convection plume within the plasma bulb.

8. The plasma cell of claim 6, wherein the one or more electrodes comprise:

a substantially flat electrode configured to protect a top portion of the bulb.

9. The plasma cell of claim 6, wherein the one or more electrodes comprise:

a filamentary electrode running along the longitudinal orientation of the plasma bulb.

10. The plasma cell of claim 6, wherein the one or more electrodes comprise:

an electrode arranged off-center relative to the center of the plasma bulb.

11. The plasma cell of claim 1, wherein the gas port assembly comprises:

a clamp configured to reversibly mechanically couple the delivery cap and the receiving cap.

12. The plasma cell of claim 1, wherein the gas comprises:

at least one of Ar, Kr, $N_2$, $H_2O$, $O_2$, $H_2$, $CH_4$, one or more metal halides, an Ar:Xe mixture, ArHg, KrHg, and XeHg.

13. The plasma cell of claim 1, wherein the glass material of the plasma bulb comprises:

at least one of a low OH content fused synthetic quartz glass material and a high OH content fused synthetic silica glass material.

14. The plasma cell of claim 1, wherein the glass material of the plasma bulb comprises:

at least one of SUPRASIL 1, SUPRASIL 2, SUPRASIL 300, SUPRASIL 310, HERALUX PLUS, and HERALUX-VUV.

15. A plasma cell equipped with a heat pipe for use in a laser-sustained plasma light source, comprising:

a plasma bulb, the bulb being formed from a glass material substantially transparent to a selected wavelength of radiation;

one or more electrodes disposed within the bulb, the one or more electrodes configured to initiate plasma generation within the bulb;

a heat pipe in thermal communication with the one or more electrodes, the heat pipe further being in thermal communication with a heat exchanger, configured to transfer thermal energy from within the plasma bulb to a medium external to the plasma bulb; and a gas port assembly, the gas port assembly configured to establish a reversible fluidic connection between a gas source and an internal portion of the plasma bulb.

16. The plasma cell of claim 15, wherein the heat pipe is configured to transfer thermal energy from one or more electrodes of the plasma bulb to a medium external to the plasma bulb.

17. The plasma cell of claim 15, wherein the heat pipe includes a volume of gas material within the external surface of the heat pipe.

18. The plasma cell of claim 15, wherein the heat pipe comprises:

a phase transition based heat pipe.

19. The plasma cell of claim 15, wherein the heat pipe is configured to transfer thermal from a plume generated by gas from a plasma region within the plasma bulb to a medium external to the plasma bulb.

20. The plasma cell of claim 15, wherein the heat pipe includes a volume of molten material within the external surface of the heat pipe.

21. The plasma cell of claim 15, wherein the bulb has at least one of a substantially cylindrical shape, a substantially spherical shape, and a substantially cardioid shape.

22. The plasma cell of claim 15, wherein the one or more electrodes comprise:

a concave electrode configured for capture and redirection of a convection plume within the plasma bulb.

23. The plasma cell of claim 15, wherein the one or more electrodes comprise:

a substantially flat electrode configured to protect a top portion of the bulb.

24. The plasma cell of claim 15, wherein the one or more electrodes comprise:

a filamentary electrode running along the longitudinal orientation of the plasma bulb.

25. The plasma cell of claim 15, wherein the one or more electrodes comprise:

an electrode arranged off-center relative to the center of the plasma bulb.

26. The plasma cell of claim 15, wherein the gas comprises:

at least one of Ar, Kr, $N_2$, $H_2O$, $O_2$, $H_2$, $CH_4$, one or more metal halides, an Ar:Xe mixture, ArHg, KrHg, and XeHg.

27. The plasma cell of claim 15, wherein the glass material of the plasma bulb comprises:

at least one of a low OH content fused synthetic quartz glass material and a high OH content fused synthetic silica glass material.

28. The plasma cell of claim 15, wherein the glass material of the plasma bulb comprises:

at least one of SUPRASIL 1, SUPRASIL 2, SUPRASIL 300, SUPRASIL 310, HERALUX PLUS, and HERALUX-VUV.

29. A plasma cell equipped with one or more radiation shields for use in a laser-sustained plasma light source, comprising:

a plasma bulb, the bulb being formed from a glass material substantially transparent to a selected wavelength of radiation, wherein the plasma bulb is configured to contain a gas suitable for plasma generation;

one or more electrodes disposed within the bulb, the one or more electrodes configured to initiate plasma generation within the bulb;

one or more radiation shields disposed on the one or more electrodes, wherein the one or more radiation shields are configured to shield the glass material of the bulb from radiation emitted by a plasma region within the plasma bulb; and a gas port assembly, the gas port assembly configured to establish a reversible fluidic connection between a gas source and an internal portion of the plasma bulb.

30. The plasma cell of claim 29, wherein the one or more electrodes comprise:

a top electrode disposed at an upper portion of the plasma bulb; and a bottom electrode disposed at a bottom portion of the plasma bulb.

31. The plasma cell of claim 30, wherein the one or more radiation shields comprise:

at least one of a top radiation shield coupled to the top electrode and a bottom radiation shield coupled to the bottom electrode.

32. The plasma cell of claim 29, wherein the one or more radiation shields are further configured to redirect convection currents from the plasma region within the plasma bulb.

33. The plasma cell of claim 29, wherein the bulb has at least one of a substantially cylindrical shape, a substantially spherical shape, and a substantially cardioid shape.

34. The plasma cell of claim 29, wherein the one or more electrodes comprise:

a concave electrode configured for capture and redirection of a convection plume within the plasma bulb.

35. The plasma cell of claim 29, wherein the one or more electrodes comprise:

a substantially flat electrode configured to protect a top portion of the bulb.

36. The plasma cell of claim 29, wherein the one or more electrodes comprise:

a filamentary electrode running along the longitudinal orientation of the plasma bulb.

37. The plasma cell of claim 29, wherein the one or more electrodes comprise:

an electrode arranged off-center relative to the center of the plasma bulb.

38. The plasma cell of claim 29, wherein the gas comprises:

at least one of Ar, Kr, $N_2$, $H_2O$, $O_2$, $H_2$, $CH_4$, one or more metal halides, an Ar:Xe mixture, ArHg, KrHg, and XeHg.

39. The plasma cell of claim 29, wherein the glass material of the plasma bulb comprises:

at least one of a low OH content fused synthetic quartz glass material and a high OH content fused synthetic silica glass material.

40. The plasma cell of claim 29, wherein the glass material of the plasma bulb comprises:

at least one of SUPRASIL 1, SUPRASIL 2, SUPRASIL 300, SUPRASIL 310, HERALUX PLUS, and HERALUX-VUV.

41. An electrodeless plasma cell suitable for use in a laser-sustained plasma light source, comprising:

a plasma bulb, the bulb being formed from a glass material substantially transparent to a selected wavelength of radiation, wherein the plasma bulb is configured to contain a gas suitable for plasma generation;

a plasma generation region within the plasma bulb, wherein the plasma generation region is configured to initiate a plasma within the bulb via absorption of radiation from a pumping laser, wherein the plasma bulb is configured to initiate the plasma without electrodes; and a gas port assembly, the gas port assembly configured to establish a reversible fluidic connection between a gas source and an internal portion of the plasma bulb.

42. The plasma cell of claim 41, wherein the plasma bulb has at least one of a substantially cylindrical shape, a substantially spherical shape, and a substantially cardioid shape.

43. The plasma cell of claim 41, wherein plasma bulb is at least one of a refillable plasma bulb and a non-refillable plasma bulb.

44. The plasma cell of claim 41, wherein the gas comprises:

at least one of Ar, Kr, $N_2$, $H_2O$, $O_2$, $H_2$, $CH_4$, one or more metal halides, an Ar:Xe mixture, ArHg, KrHg, and XeHg.

45. The plasma cell of claim 41, wherein the glass material of the plasma bulb comprises:

at least one of SUPRASIL 1, SUPRASIL 2, SUPRASIL 300, SUPRASIL 310, HERALUX PLUS, and HERALUX-VUV.

46. The plasma cell of claim 41, wherein the glass material of the plasma bulb comprises:

at least one of a low OH content fused synthetic quartz glass material and a high OH content fused synthetic silica glass material.

* * * * *